United States Patent [19]

Kawakami et al.

[11] Patent Number: 5,043,318

[45] Date of Patent: Aug. 27, 1991

[54] DYE TRANSFER TYPE THERMAL PRINTING SHEET

[75] Inventors: Tetsuji Kawakami; Hiromu Matsuda, both of Katano; Sigeru Tanimori, Hirakata; Yoshinori Sano, Kobe, all of Japan

[73] Assignees: Matsushita Electric Industrial Co., Ltd.; Nippon Shokubai Kagaku Kogyo Co., Ltd., both of Osaka, Japan

[21] Appl. No.: 491,851

[22] Filed: Mar. 12, 1990

[30] Foreign Application Priority Data

Mar. 13, 1989 [JP] Japan ..... 1-59932

[51] Int. Cl.[5] ..... B41M 5/035; B41M 5/26

[52] U.S. Cl. ..... 503/227; 8/471; 427/146; 428/195; 428/447; 428/913; 428/914

[58] Field of Search ..... 8/471; 428/195, 447, 428/913, 914; 503/227; 427/146

[56] References Cited

U.S. PATENT DOCUMENTS

| | | | |
|---|---|---|---|
| 3,458,355 | 7/1969 | Newman | 117/15 |
| 4,724,228 | 2/1988 | Hann | 503/227 |

FOREIGN PATENT DOCUMENTS

| | | | |
|---|---|---|---|
| 0282080 | 9/1988 | European Pat. Off. | 428/488.4 |
| 50-95388 | 7/1975 | Japan | 503/227 |
| 63-27291 | 2/1988 | Japan | 503/227 |
| 63-281892 | 11/1988 | Japan | 503/227 |

OTHER PUBLICATIONS

Matsuda et al., "Partially Reusable Printing Characteristics of Dye Transfer Type Thermal Printing Sheets", Papers for the 2nd Nonimpact Printing Technology Symposium (1985), pp. 101-104.

"Study on Sublimation Type Film for Multiple Recording", Preprints for 1986 Annual Meeting of Image Electronics Society.

Matsuda et al., "Multi-Usable Dye Transfer Sheets", Preprints for the 61st Study and Discussion Meeting of the Society of Electrophotography, pp. 266-269.

Patent Abstracts of Japan, vol. 11, No. 168 (M-594)[2615], 5/29/87 for JP-A-62 1582 and JP-A-62 1574.

*Primary Examiner*—Bruce H. Hess

*Attorney, Agent, or Firm*—Wenderoth, Lind & Ponack

[57] ABSTRACT

The present invention provides dye transfer type thermal printing sheet comprising a base sheet, a dye-containing layer formed on the base sheet and a dye-permeable layer which is formed on the dye-containing layer and comprises at least one water dispersible polysiloxane graft polymer which is obtainable by polymerizing (B) 0.05 to 10% by weight of a polymerizable silane compound, (C) 1 to 30% by weight of an unsaturated organic acid and (D) 40 to 97.95% by weight of a monomer which is copolymerizable with the silane compound (B) and the unsaturaed organic acid (C) in the presence of (A) 1 to 20% by weight of a polysiloxane having terminal hydroxyl groups (provided that the total of the components (A), (B), (C) and (D) is 100% by weight) in an organic solvent except an alcohol or at least one salt of said graft polymer with a base, which has good storage stability, generates images with improve weather durability and prevents great decrease of print density as increase of the number of printing times.

6 Claims, 2 Drawing Sheets

DYE TRANSFER TYPE THERMAL PRINTING SHEET

BACKGROUND OF THE INVENTION

1. Field of the Invention

The present invention relates to a dye transfer type thermal printing sheet from which a dye is transferred onto a color developing layer of an image-receiving sheet to form an image and which is for multiple use where the same part of the printing sheet is used repeatedly.

2. Description of the Related Art

Dye transfer type thermal printing which uses dyes having high sublimation properties is a kind of full-color recording system which enables printing with concentration gradation at each recording dot. Since the printing sheet is expensive, many attempts on multiple use of the printing sheet have been reported in, for example, (1) "Partially Reusable Printing Characteristics of Dye Transfer Type Thermal Printing Sheets" (Papers for the 2nd Nonimpact Printing Technology Symposium (1985), pages 101-104); (2) "Study on Sublimation Type Film for Multiple Recording" (Preprints for 1986 Annual Meeting of Image Electronics Society); (3) Japanese Patent Kokai Publication No. 27291/1988; and (4) "Multi-Usable Dye Transfer Sheets" (Preprints for the 61st Study and Discussion Meeting of the Society of Electrophotography, pages 266-269).

The multiple recording modes are classified into two one of which is a simple repeating mode in which the same part of the printing sheet is used N times and the other of which is an n-times relative speed mode in which a supply speed of the printing sheet is adjusted to 1/n time of that of the image-receiving sheet so that n-times multiple printing is performed. The above four conventional arts (1) through (4) relate to the multiple recording by the relative speed mode. Since a fresh part of the printing sheet is always supplied in the relative speed mode, the substantial number of repeat is larger in the relative speed mode than in the simple repeating mode.

The relative speed mode requires some measure to keep lubricity between the printing sheet and the image-receiving sheet. The conventional arts (1) and (3) used spherical spacer particles or solid lubricants such as molybdenum disulfide to keep the lubricity between the printing sheet and the image-receiving sheet. In the above conventional art (2), the recording by the relative speed mode is achieved by closely contacting the printing sheet and the image-receiving sheet. However, the report (2) is silent on a measure for keeping the lubricity. In the report (4), decrease of a dye concentration in a dye layer surface is prevented by controlling easiness of diffusion of the dye in the dye layer or the color developing layer of the image-receiving sheet or by forming a concentration distribution in a direction of thickness of the dye layer. Thereby, the quality of the multiple printing is improved. In addition, a lubricant is added to the dye layer and the color developing layer of the image-receiving sheet.

To realize the full-color image printing having the same quality as a general printing (one-time printing), it is necessary to achieve the same saturated print density (about 1.5 to 1.8) as that in the general printing and small variation of the printing concentration against the same recording energy during multiple printing so as to avoid the influence of print hysteresis.

In the conventional art (1), once a sufficient amount of the dye for multiple printing is used, the printing characteristics are satisfied. However, since a space is kept between the printing sheet and the image-receiving sheet to give lubricity for relative speed traveling and to determine a printing rate by the sublimation step, the dye should be one having a high sublimation property. Although, in the conventional art (2), a weather durabili a low sublimation property can be used because of contact diffusion printing, the print density against the same recording energy greatly decreases as the number of prints increases even if the sufficient amount of the dye for multiple printing is supplied. As the result, the saturated print density achieved by the multiple printing does not reach a practical level. In the conventional art (3), as in the conventional art (1), the print density decreases in comparison to the system having no spacer. When the particle size of the spacer is small, decrease of the recording concentration caused by increase of the relative speed ratio cannot be ignored.

Contrary to the above, the conventional art (4) uses a dye transfer type printing sheet comprising a base sheet and a dye layer containing a dye in such concentration distribution that a weight concentration on the layer surface side is lower than that on the base sheet side, whereby it is possible to use the same part of the printing sheet many times in the contact diffusion printing. However, when a layer containing the dye in a lower concentration and an oil-soluble resin is coated in the form of a solution in an organic solvent on an already coated layer containing the dye in a high concentration, the latter is dissolved so that it is difficult to keep the low dye concentration on the surface side. Therefore, the expected high multiple printing performance is not necessarily achieved. Since no spherical spacer is used, the printing sheet tends to weld or stick easily to the image-receiving sheet, and it is difficult to perform the relative speed mode printing. To perform the relative speed printing, a lubricant such as a fatty acid derivative having a comparatively low molecular weight or a wax and silicone oil which is in the liquid state at room temperature is added. However, the lubricant induces recrystallization of the dye on the dye layer surface. Therefore, the printing sheet has poor storage stability, or the lubricant is transferred to the surface of the image-receiving sheet so that the weather durability of the printed image is deteriorated.

SUMMARY OF THE INVENTION

One object of the present invention is to provide a dye transfer type thermal printing sheet for multiple use which has good surface lubricity even in the absence of a lubricant so that said printing sheet is used in the relative speed mode printing, has good storage stability and gives images with improved weather durability.

Another object of the present invention is to provide a dye transfer type thermal printing sheet for multiple use which enables the relative speed mode printing even in the absence of spherical spacers so that it is possible to use a weather durable dye with high utility and low sublimation property.

A further object of the present invention is to provide a dye transfer type thermal printing sheet multiple use, with which the decrease of print density against the same recording energy is small as the number of prints increases, and the high saturated print density is achieved.

A yet another object of the present invention is to provide a dye transfer type thermal printing sheet for multiple use which enables the full-color printing with the same quality as the general one time printing at a low running cost.

These and other objects of the present invention are achieved by a dye transfer type thermal printing sheet comprising a base sheet, a dye-containing layer formed on the base sheet and a dye-permeable layer which is formed on the dye-containing layer and comprises at least one water dispersible polysiloxane graft polymer which is obtainable by polymerizing (B) 0.05 to 10% by weight of a polymerizable silane compound, (C) 1 to 30% by weight of an unsaturated organic acid and (D) 40 to 97.95% by weight of a monomer which is copolymerizable with the silane compound (B) and the unsaturated organic acid (C) in the presence of (A) 1 to 20% by weight of a polysiloxane having terminal hydroxyl groups (provided that the total of the components (A), (B), (C) and (D) is 100% by weight) in an organic solvent except an alcohol or at least one salt of said graft polymer with a base. The dye-permeable layer may contain the dye in a concentration smaller than that in the dye-containing layer. In the present invention, the dye-containing layer and the dye-permeable layer constitute a dye layer.

DETAILED DESCRIPTION OF THE INVENTION

Figure 1:
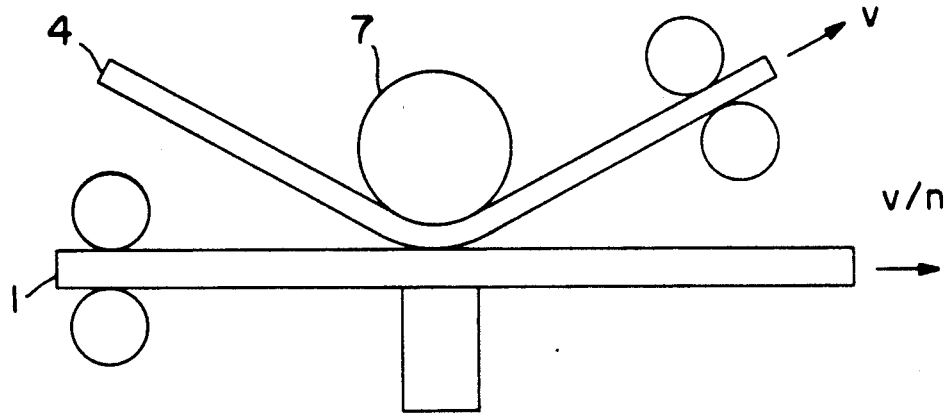
FIG. 1 shows a principle of the relative speed mode multiple printing.

The mechanism for the improvement of the recording characteristics in the multiple printing by the printing sheet of the present invention is explained.

When the recording is performed by contacting the dye transfer type thermal printing sheet against the image-receiving sheet, transfer of the dye is controlled by diffusion of the dye from the dye layer to the color developing layer of the image-receiving sheet. Then, the change of the dye concentration at the surface of the dye layer during the multiple printing should be noted. In the conventional dye layer, since there is no dye concentration gradient, the dye near the surface is consumed in the first printing step so that the dye concentration near the surface decreases to about a half of that in the inside of the dye layer. In the second and subsequent printing steps, the dye is supplied to the surface from the inside by the concentration gradient in the dye layer so that the decrease of the dye concentration near the surface is very small. Therefore, the print density greatly decreases between the first printing and the second printing when the same recording energy is applied during the multiple printing. If the dye concentration near the surface is made smaller than that in the inside to form a concentration gradient in the dye layer of the unused printing sheet, the dye is supplied from the inside to the surface from the first printing step so that the great decrease of the dye concentration near the surface and, in turn, the great decrease of the print density from the first printing step to the second printing step can be prevented. To achieve this, the dye layer of the present invention consists of the dye-containing layer and the dye-permeable layer.

The function of the present invention will be explained in detail.

Since the dye-permeable layer comprises the water dispersible resin, it is not necessary to use an organic solvent to apply the dye-permeable layer on the dye-containing layer. Thereby, the re-dissolution of the dye-containing layer and, in turn, increase of the concentration of the dye in the dye-permeable layer can be prevented. Therefore, the multiple printing performance of the printing sheet of the present invention is not deteriorated.

The water dispersible resin herein used is intended to mean one which can be dispersed in water or a mixture of water and a suitably small amount of an organic solvent but cannot be redispersed or dissolved in water after applied and dried to form a film.

The water dispersible resin to be used in the present invention is a polysiloxane graft polymer defined as above. The use of such water dispersible resin has various advantages. Although such water dispersible resin forms a stable aqueous dispersion before application and formation of the film, the film formed by evaporation of the aqueous medium has a very low surface energy and therefore good surface properties such as non-tackiness, water-repellency and lubricity.

Various aqueous dispersions of polysiloxane graft polymers have been proposed. For example, Japanese Patent Kokai Publication No. 95388/1975 discloses an aqueous dispersion which is prepared by polymerizing a vinyl compound having a carboxyl group and a hydroxyl group in a hyrrophilic organic solvent, reacting the resulting vinyl polymer with an organopolysiloxane having a hydroxyl group or an alkoxyl group and diluting the reaction mixture with water, and Japanese Patent Kokai Publication No. 146525/1976 discloses an aqueous dispersion which is prepared by emulsion polymerizing an organopolysiloxane having a polymerizable double bond and a vinyl monomer in the presence of an emulsifier. However, since the reactivity between the vinyl polymer and the organopolysiloxane is low in the former aqueous dispersion, or copolymerizability between the vinyl monomer and the organopolysiloxane is low in the latter aqueous dispersion, it is difficult to obtain a polysiloxane graft polymer having high grafting rate, the polysiloxane component separates in the dispersion so that the film cannot be formed, or if the film can be formed, it does not have sufficiently the surface properties resulting from he polysiloxane or it contaminates other materials with which it contacts. Purification of the prepared dispersion cannot remove such drawbacks and only makes the preparation step complicate or increases the production cost. Further, such drawbacks become more remarkable as the molecular weight of the organopolysiloxane increases.

In the water dispersible resin to be used in the present invention, it is possible to introduce the polysiloxane component having a molecular weight of 5000 to 1,500,000, preferably 20,000 to 1,500,000. When the polysiloxane component having such large molecular weight is used, orientation of the polysiloxane structures to the surface of the dye-permeable layer is enhanced so that the concentration of the polysiloxane component at the surface of the dye-permeable layer is increased and lubricity of the dye-permeable layer is greatly improved.

Unlike higher fatty acid derivatives, a coagulated structure of the polysiloxane component at the surface of the dye-permeable layer is not broken at a temperature higher than the melting point and the surface energy does not increase, whereby the surface energy thereof is kept low even at a high temperature. Since the polysiloxane chains are grafted to a backbone chain through covalent bonds, they do not migrate into the binder resin which composes the dye layer or is not transferred to the color developing layer of the image-receiving sheet at the high temperature and/or under high pressure. Therefore, at high temperatures during thermal printing or at high relative speed between the printing sheet and the image-receiving sheet, the surface energy of the dye layer is kept low because of the presence of the polysiloxane component, whereby the relative speed printing becomes possible. Since the polysiloxane does not migrate to the image-receiving sheet when heated, the recorded image on the image-receiving sheet is not adversely affected by the polysiloxane component.

The present invention will be illustrated by making reference to the accompanying drawings.

FIG. 1 schematically shows a principle of the relative speed mode multiple printing.

A transfer type printing sheet 1 and an image-receiving sheet 4 are pressed against a thermal head 8 with a platen 7 so that they closely contact each other. When the image-receiving sheet 4 is moved at a speed of v with respect to the thermal head 8, the printing sheet 1 is moved at a speed of v/n (n being a positive number). The moving direction of the printing sheet 1 may the same as or reverse to that of the image-receiving sheet 4. Since the printing sheet 1 is heated with the thermal head 8, the dye layer of the printing sheet 1 and the color developing layer of the image-receiving sheet 4 tend to weld or stick together. To prevent the welding or stick, at least one of the dye layer and the color developing layer has sufficient lubricity.

Figure 2:
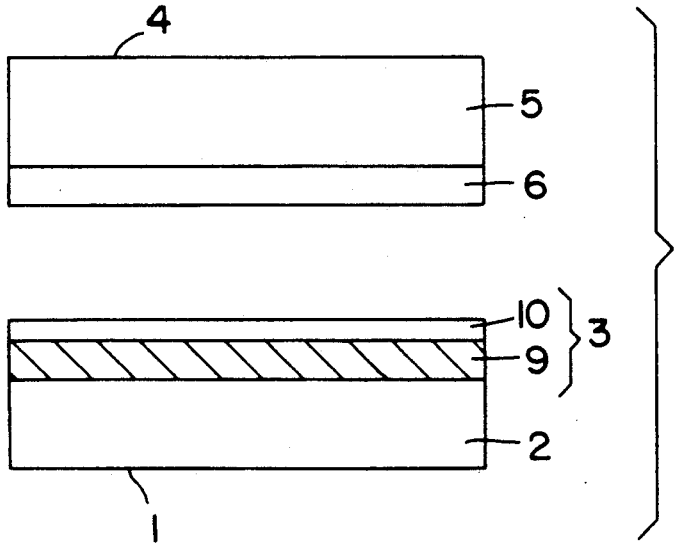
FIG. 2 shows cross sections of one embodiment of the dye transfer type thermal printing sheet of the present invention and an image-receiving sheet.

The structures of the dye transfer type printing sheet and the image-receiving sheet are now explained with reference to FIG. 2.

The dye transfer type printing sheet 1 comprises a base sheet 2 and a dye layer 3 which consists of a dye-containing layer 9 and a dye-permeable layer 10.

The image-receiving sheet 4 comprising a base sheet 5 and a color developing layer 6.

When the dye transfer type printing sheet comprises the dye-containing layer and the dye-permeable layer containing the water dispersible resin which are successively laminated on the base sheet, the dye-permeable layer can be coated in the form of an aqueous dispersion on the dye-containing layer, whereby the concentration of the dye in the dye-permeable layer can be sufficiently lower than that in the dye-containing layer, which solves such problem that the dye-permeable layer contains a comparatively high concentration of the dye so that the multiple printing characteristics are not desirably improved as encountered when the oil soluble resin is used.

In addition, according to the present invention, it is possible to suppress the decrease offprint density as the relative speed ratio n is increased in the relative speed mode in which the speed of the dye transfer printing sheet in relation to the thermal head is smaller than that of the image-receiving sheet and the dye is transferred from the dye layer to the color developing layer of the image-receiving sheet by selectively heating a part of the printing sheet from its back face or a part of the image-receiving sheet from its back face. Since the part of the printing sheet which is used for printing is less damaged in the relative speed mode than in the simple repeating mode, the quality of the printed image less fluctuates.

It is necessary to impart lubricity to the surface of the dye layer of the printing sheet or to the color developing layer of the image-receiving sheet to avoid welding or stick under the high temperature printing condition. Since the conventional water soluble or dispersible resins have many hydrophilic groups which increase surface free energy of the resin layer and cause welding or stick. The polysiloxane graft polymer to be used according to the present invention can decrease the surface free energy of the dye layer, prevent the welding or stick and impart lubricity sufficient for the relative speed mode of the multiple printing.

Figure 3:
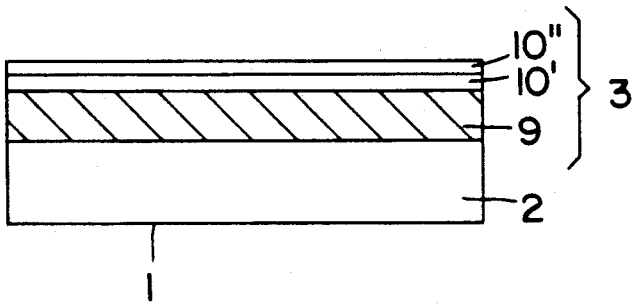
FIG. 3 is a cross section of another embodiment of the dye transfer type thermal printing sheet of the present invention.

The dye transfer type printing sheet of the present may be produced by various methods. For example, the dye-containing layer is first formed on the base sheet and then the aqueous dispersion of the polysiloxane graft polymer is applied on the formed dye-containing layer and dried. Alternatively, as shown in FIG. 3, on the dye-containing layer 9, a first dye-permedable layer 10' containing the dye in a smaller concentration is formed and then the second dye-permeable layer 10'' containing no dye is formed. The second dye-permeable layer acts as a lubrication layer. This structure increases the storage stability of the printing sheet. To further improve the lubricity, the dye-permeable layer may contain lubricant particles a particle size of which is not so large in relation to the thickness of the dye-permeable layer.

As the dye, any of the conventionally used ones such as disperse dyes, basic dyes, dye formers of basic dyes can be used.

A heating source necessary for thermal printing may be any of conventional ones such as a thermal head, a resistance system with an electrode head, a heat mode heating with a laser and the like. The kinds of the base sheets for the printing sheet and the image-receiving sheet may be selected from the conventional material according to the heating source. For example, a base sheet for the dye transfer type printing sheet to be used in combination with the thermal head is made of polyesters (e.g. polyethylene terephthalate, polyethylene naphthalate, polycarbonate, etc.), polyamides (e.g. nylon), cellulose derivatives (e.g. acetylcellulose, cellophane, etc.) and polyimides (e.g. polyimides, polyamideimide, poletherimide, etc.). On the surface to which the thermal head directly contacts, a heat resistant layer or a lubrication layer may be formed. For resistance heating or induction heating, a base sheet having electrical conductivity is used.

A kind of the binder resin to form the dye-containing layer is not critical. Examples of the binder resin are polyester resins, butyral resins, formal resins, polyamide resins, polycarbonate resins, urethane resins, chlorinated polyethylene, chlorinated polypropylene, poly(-meth)acrylate resins, polyphenylene oxide, cellulose derivatives and the like. They can be used independently or as a mixture according to the desired performances.

In addition to the dye and the binder resin, the dye-containing layer may contain other additives such as lubricant, a dye-dispersant, etc. Silicone compounds or waxes should be carefully used, since they decrease the surface free energy of the dye-containing layer so that it is difficult to apply the aqueous dispersion for the dye-permeable layer.

Examples of solvents for the preparation of an ink which is used for the formation of the dye-containing layer are alcohols (e.g. methanol, ethanol, propanol, butanol, etc.), cellosolves (e.g. methylcellosolve, ethylcellosolve, etc.), aromatic solvents (e.g. benzene, toluene, xylene, etc.), esters (e.g. butyl acetate, etc.), ketones (e.g. acetone, 2-butanone, cyclohexanone, etc.) nitrogen-containing compounds (e.g. N,N-dimethylformamide, etc.), halogenated hydrocarbons (e.g. dichloromethane, chlorobenzene, chloroform, etc.) and the like. The ink may be applied on the base sheet by any of conventional methods, for example, with a reverse roll coater, a gravure coater, a rod coater or an air doctor coater, or by spraying the ink composition on the base sheet surface or dip-coating one surface of the base sheet with the ink.

The aqueous dispersion for the dye-permeable and the composition for the lubrication layer can be applied by the same manners as above.

The thickness of the dye-containing layer depends on the concentration of the dye therein, the desired printing number or the relative speed ratio and the dye amount necessary for the maximum print density on the image-receiving sheet. The minimum applied amount of the dye in the dye-containing layer can be calculated by the following equation:

$$\text{Minimum applied amount of dye (g/m}^2) = (\text{desired number of print}) \times (\text{required dye amount, g/m}^2)/(\text{dye concentration by weight})$$

The applied dye-containing layer or dye-permeable layer can be dried by any of conventional methods such as application of hot air or infrared. In view of drying speed and cost, hot air drying is preferred.

The water dispersible polysiloxane graft polymer to be used for the formation of dye-permeable layer is obtainable by polymerizing (B) 0.05 to 10% by weight of a polymerizable silane compound, (C) 1 to 30% by weight of an unsaturated organic acid and (D) 40 to 97.95% by weight of a monomer which is copolymerizable with the silane compound (B) and the unsaturated organic acid (C) in the presence of (A) 1 to 20% by weight of a polysiloxane having terminal hydroxyl groups (provided that the total of the components (A), (B), (C) and (D) is 100% by weight) in an organic solvent except an alcohol.

An example of the polysiloxane having terminal hydroxyl groups is a polysiloxane of the formula:

$$HO-(\overset{R^1}{\underset{R^2}{Si}}-O)_n-R^3 \quad (I)$$

wherein $R^1$ and $R^2$ are the same or different and each a monovalent hydrocarbon group which may be substituted with a halogen atom, $R^3$ is a hydrogen atom or a monovalent hydrocarbon group, and n is a positive integer larger than 1 (one). The variety of the polysiloxanes of the formula (I) are commercially available and used depending on the final use. In addition to the polysiloxane (I), polysiloxanes having a side chain may be used as the polysiloxane (A). In particular, dialkylpolysiloxanes (e.g. dimethylpolysiloxane, methylethylplysiloxane, etc.), diarylpolysiloxanes (e.g. diphenylpolysiloxane, etc.) or mixtures thereof may be used.

Among them, the straight or partially branched polysiloxane having at least one hydroxyl group at the chain ends is preferred since it is easily available and gives a polysiloxane graft polymer having good properties.

An amount of the polysiloxane (A) is determined in the range of 1 to 20% by weight based on the surface characteristics of the formed layer. When this amount is less than 1% by weight, the obtained graft polymer does not have sufficient properties for the dye-permeable layer. When this amount exceeds 20% by weight, the adherence of the dye-permeable layer to the dye-containing layer undesirably decreases.

The polymerizable silane compound (B) is a compound containing at least one polymerizable unsaturated group and at least one group which proceeds condensation reaction with the above polysiloxane (A). Specific examples of the polymerizable silane compound (B) are vinyltrimethoxysilane, vinyltriethoxysilane, vinyltributoxysilane, vinyltris(β-methoxyethoxy)-silane, allyltriethoxysilane, γ-(meth)acryloxypropyltrimethoxysilane, γ-(meth)acryloxy-propyltriethoxysilane, γ-(meth)acryloxypropylmethyldimethoxysilane, γ-(meth)acryloxypropylmethylethoxysilane, γ-(meth)acryloxypropyltris(β-methoxyethoxy)silane, 2-styrylethylethyltrimethoxysilane, (meth)acryloxyethyldimethyl(3-trimethoxysilylpropyl)ammonium chloride, vinyltriacetoxysilane, vinyltrichlorosilane and mixtures thereof.

An amount of the polymerizalbe silane compound (B) is determined in the range of 0.05 to 10% by weights. When this amount is less than 0.05% by weight, the polymer chains comprising the polymerizable silane compound (B), the unsaturated organic acid (C) and the copolymerizable monomer (D) do not bond sufficiently to the polysiloxane (A) so that the effective amount of grafting reaction does not proceed, and the unreacted polysiloxane tends to be phase separated in the aqueous dispersion of the graft polymer. When this amount is larger than 10% by weight, stability of the polymerization mixture becomes unstable so that the polymer tends to form gel.

The unsaturated organic acid (C) smoothly proceeds the grafting reaction between the polymerized chains and the polysiloxane (A) and also renders the resulting polysiloxane graft polymer water-dispersible. Specific examples of the unsaturated organic acid (C) are unsaturated carboxylic acids (e.g. acrylic acid, methacrylic acid, maleic acid, itaconic acid, etc.), unsaturated sulfonic acids (e.g. vinylsulfonic acid, sulfoethyl methacrylate, 2-acrylamide-2-methylpropanesulfonic acid, etc.) and mixtures thereof.

An amount of the unsatured organic acid (C) is determined in the range of 1 to 30% by weight, preferably 3 to 20% by weight. When this amount is less than 1% by weight, a stable aqueous dispersion of the polysiloxane graft polymer is not prepared. When this amount exceeds 30% bu weight, the resulting graft polymer is too hydrophilic so that not only it is difficult to prepare a stable aqueous dispersion but also the resulting polysiloxane graft polymer has inferior water resistance.

Examples of the copolymerizable monomer (D) are acrylates (e.g. butyl acrylate, 2-ethylhexyl acrylate, etc.), hydroxyalkyl (meth)acrylates (e.g. 2-hydroxyethyl (meth)acrylate, 2-hydroxypropyl (meth)acrylate, etc.), methacrylates (e.g. methyl methacrylate, butyl methacrylate, etc.), vinyl esters (e.g. vinyl acetate, vinyl propionate, etc.), aromatic vinyl compounds (e.g. styrene, vinyltoluene, etc.), unsaturated nitriles (e.g. acrylonitrile, methacrylonitrile, etc.), unsaturated amides (e.g. acrylamide, N-methylolacrylamide, etc.), vinyl ethers (e.g. methyl vinyl ether, ethyl vinyl ether, tert.-butyl vinyl ether, etc.), halogen-containing $\alpha,\beta$-unsaturated monomers (e.g. vinyl chloride, vinylidene chloride, vinyl fluoride, vinylidene fluoride, etc.), fluorine-containing (meth)acrylates (e.g. trifluoroethyl (meth)acrylate, 2,2,3,3-tetrafluoropropyl acrylate, 1H,1H, 2H,2H-heptadecafluorodecyl acrylate, 1H,1H,5H-octafluoropentyl acrylate, etc.), fluorine-containing aromatic acrylates (e.g. 2,3,5,6-tetrafluorophenyl acrylate, 2,3,4,5,6-pentafluorophenyl acrylate, etc.) and mixtures thereof.

An amount of the copolymerizable monomer is determined in the range of 40 to 97.95% by weight. When this amount is less than 40% by weight or larger than 97.95% by weight, the amounts of the polysiloxane (A), the polymerizable silane compound (B) and/or the unsaturated organic acid (C) are outside the above ranges so that the drawbacks described above will appear.

The graft polymerization is carried out in the organic solvent other than alcohols. That is, any organic solvent having no alcoholic hydroxyl group can be used. Preferred examples of the solvent are toluene, xylene, benzene, cyclohexane, trichloroethane, methyl ethyl ketone, ethyl acetate, dioxane, cellosolve acetate and mixtures thereof. Among them, toluene and xylene are more preferred because of solubility of the resulting graft polymer therein and the boiling points.

Since the organic solvents having eh alcoholic hydroxyl group such as alcohols (e.g. methanol, ethanol, isopropanol, etc.) and cellosolves (e.g. methylcellosolve, ethylcellosolve, etc.) will suppress the grafting reaction between the polyxiloxane (A) and the polymer chain formed from the components (B), (C) and (D), they cannot be used from the beginning of the graft polymerization. But, they may be added to the reaction system after the graft polymerization sufficiently proceeds.

As a polymerization initiator, any of conventional used radical polymerization initiators may be used. Preferred examples are azo compounds (e.g. azobisisobutyronitrile, etc.) and peroxides (e.g. benzoyl peroxide, etc.).

The polymerization temperature is usually from room temperature to 200° C., preferably from 40° to 120° l C.

The polymerization concentration is usually from 30 to 70% by weight, preferably from 40 to 60% by weight.

To prepare a salt of the polysiloxane graft polymer, any of bases which are used for neutralizing an acid can be used. Specific examples of the base are sodium hydroxide, potassium hydroxide, calcium hydroxide, ammonial, trimethylamine, triethylamine, methyldiethylamine, monomethyloldimethylamine, monomethyloldiethylamine, dimethyloethylamine and mixtures thereof. The base is used to convert the polysiloxane graft polymer to a water dispersible salt and used in an amount of 20 to 200% by mole based on the acid groups contained in the polysiloxane graft polymer. When the amount of the base is less than above lower limit, the polymer may not have sufficient water dispersibility. To achieve good dispersion state during storage and to prepare the aqueous dispersion of the polysiloxane graft polymer which does not suffer from the defects due to the base such as decrease of water resistance and discoloration, the amount of the base is preferably from 50 to 100% by mole based on the acid groups contained in the polysilozane graft polymer.

In the aqueous dispersion, an emulsifier and/or a protective colloid may be added. In view of the performances of the aqueous dispersion of the polysiloxane graft polymer, the amount of the emulsifier and/or the protective colloid should be as small as possible. Preferably, no emulsifier or protective colloid is used.

To use the polysiloxane graft polymer as the component of the dye-permeable layer, the graft polymer should be dispersed in an aqueous medium. To prepare the aqueous dispersion, to the solution of the polysiloxane graft polymer in the organic solvent, a mixture of the base and water is added and mixed to form the aqueous dispersion. Preferably, the organic solvent is removed from the aqueous dispersion. Thereby, the content of organic solvent in the aqueous paint for the dye-permeable layer is decreased, so that the extraction of the dye from the dye-containing layer with the organic solvent is suppressed and the increase of the dye concentration in the dye-permeable layer is prevented. To prepare the aqueous dispersion of the polysiloxane graft polymer which is stable enough to be used in the preparation of the aqueous paint, the amount of the base should be 20 to 200% by mole, preferably 30 to 100% by mole based on the acidic groups in the polysiloxane graft polymer. To prepare the aqueous dispersion having smaller particle size and better stability, water is used in an amount of 30 to 1000 parts by weight per 100 parts by weight of the polysiloxane graft polymer, and an amount of the water soluble organic solvent before or after the addition of water is selected to be 30 to 100% by weight per total weight of the organic solvents.

To achieve adequate diffusion of the dye through the polysiloxane graft polymer under printing conditions and to prevent adhesion of the dye-permeable layer to the back face of the printing sheet when wound, the polysiloxane graft polymer has a glass transition temperature in a range from a storage temperature and 200° C.

The dye-permeable layer may contain other water-soluble or dispersible resin in addition to the polysiloxane graft polymer or the lower part of the dye-permeable layer may be formed from other water-soluble or -dispersible resin. Examples of the other water-soluble or -dispersible resin are celluloses, gelatin, polyvinyl alcohol, poly(meth)acrylates or their metal salts, polyacrylamide, urethane resins, acrylic resins, polyester resins and the like. Since the dye cannot diffuse at a high rate through a layer of polyvinyl alcohol which has a large saponification value or a homopolymer of acrylic acid, sufficient printing sensitivity cannot be achieved with a thick dye-permeable layer containing a larger amount of such polymer or the fluctation of the thickness of the dye-permeable layer has great influence on the recording sensitivity or the multiple printing performances. Examples of the water-soluble or -dispersible resin through which the dye diffuses at a suitable rate are polyvinyl alcohol having a saponification value of 30 to 90%, water-soluble or -dispersible polyester resins, water-soluble or -dispersible polyurethane resins, water-soluble or -dispersible acrylic resins and the like.

As the lubricant which is optionally contained in the dye-permeable layer, any of the lubricates which can be dissolved or emulsified in the aqueous paint may be used. Examples of the lubricant are silicone oils, waxes and fatty acid derivatives. However, the lubricant may have adverse affects on the printed image, they should be carefully selected and used.

The kind of the particles which impart lubricity to the dye-permeable layer is not limited. Preferably, polytetrafluoroehylene fine power is used because of its small surface energy.

The aqueous paint of the formation of dye-permeable layer is prepared by using water as a solvent in general. In addition to water, alcohols, ketones, cellosolves and the like may be used in such amount that the dye is not extracted from the dye-containing layer.

The aqueous dispersion for the dye-permeable layer may contain a cross linking agent.

A thickness of the dye-permeable layer depends on the diffusion rate of dye in the water-soluble or -dispersible resin, the dye concentration, an amount of energy required for intended printing, the number of prints or the relative speed rate n in the relative speed mode. When the number of prints, namely n is several tens, the thickness of the dye-permeable layer is from 0.1 to 1 μm.

The dye concentration in the dye-permeable layer is lower than that in the dye-containing layer and can be 0 (zero) %. Said concentration is adjusted according to the diffusion ability of the dye through the dye-permeable layer and/or the thickness of the dye-permeable layer. To add the dye to the dye-permeable layer, the dye may be contained in the paint for the dye-permeable layer, the dye may be diffused from the dye-containing layer to the dye-permeable layer by heating for drying the coated paint for the dye-permeable layer. These two manners may be combined.

In the former manner, it is difficult to dissolve a sufficient amount of a dye which is hardly soluble in water such as the disperse dye in the paint. The addition of a co-solvent such as an alcohol can make it possible to dissolve a certain amount of the water hardly soluble dye in the paint, but, a care should be taken not to dissolve the dye-containing layer with the co-solvent during the coating of the dye-permeable layer. It can be contemplated to disperse such dye with the use of a dispersant. However, if the dye is dispersed without finely grinding the dye particles, the surface smoothness of the printing sheet is decreased so that the printing sheet is not intimately contacted to the image-receiving sheet and the quality of the printed image is decreased. Thus, the former manner is not easy to apply.

In the latter manner, during drying the coated dye-permeable layer, the drying temperature and time and an amount of hot air for drying can be adequately adjusted so as to minimize the change of recording density by the same recording energy against the printing number. Then, the latter manner is easier than the former.

The application and drying of the dye-permeable layer can be carried out in the same manners as for the dye-containing layer. When the applied paint is dried with hot air, the dried state of the layer can be adjusted by controlling a temperature and amount of hot air or drying time. When a volatile base is used for forming the salt of polysiloxane graft polymer, the salt may be converted to the free form of the polysiloxane graft polymer according to the drying conditions. Such conversion has no material influence on the use of the printing sheet of the present invention. However, excessive drying of the dye-permeable layer not only dries the dye-permeable layer but also thermally softens the dye-containing layer so that the migration of the dye from the dye-containing layer to the dye-permeable layer is accelerated excessively to increase the dye concentration at the surface of the dye-permeable layer. Increase of the dye concentration at the surface of the dye-permeable layer deteriorates multiple printing performances of the produced printing sheet. The drying conditions vary with a kind of drying apparatus or a drying manner. When the hot air kept at a temperature from 50° to 180° C. is used, the dye-permeable layer may be dried in a reasonable period of time.

The image-receiving sheet comprises the base sheet and the color developing layer as described above. The base sheet may be transparent or opaque. The transparent sheet film includes a polyester film and the like, and the opaque one includes a synthetic resin film comprising polyesters or polypropylene, coated paper, plain paper and the like.

The color developing material in the color developing layer includes polyester, polyamide, acrylic resin, acetate resin, cellulose derivatives, starch, polyvinyl alcohol and the like. In addition, cured resins such as cured products of acrylic acid, acrylates, polyester, polyurethane, polyamide and acetate with heat, light or electron beam may be used.

PREFERRED EMBODIMENTS OF THE INVENTION

The present invention will be explained further in detail by following examples, in which "parts" are by weight unless otherwise indicated.

In all Examples, as a base sheet for the dye transfer type thermal printing sheet, was used an aromatic polyamide film with a thickness of 6 μm on which a heat resistant lubricating layer was formed. The image-receiving sheet was prepared by applying a coating paint consisting of a UV curable resin (SP 5003 distributed by Showa Polymer Co , Ltd.) (10 g), a sensitizer (Irgacure 184 manufactured by Nippon Ciba Geigy) (0.1 g) and an amide-modified silicone oil (KF 3935 manufactured by Shin-etsu Chemical Co., Ltd.) (0.05 g) dissolved in toluene (10 g) with a wire bar on a sheet of white synthetic paper made of polyethylene terephthalate as a base sheet, drying the coated paint with hot air, curing the polymer with irradiation of UV light from a 1 kW high pressure mercury lamp for one minutes to form a color developing layer. The dye used was a compound of the formula:

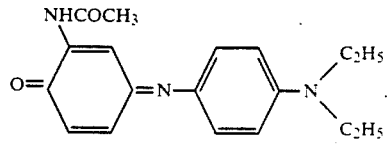

As printing means, a thermal head was used. The printing conditions were as follows:

| | |
|---|---|
| Recording period: | 16.7 ms/line |
| Pulse width: | max. 4.0 ms |

-continued

| | |
|---|---|
| Resolution: | 6 lines/mm |
| Recording energy: | 6 J/cm$^2$ (variable) |
| Moving speed: | |
| Printing sheet: | 1 or 2 mm/sec.*(1) |
| Image-receiving sheet: | 10 mm/sec. |

Note: *(1) In case of the relative speed mode. In the simple repeating mode, the moving speed of the printing sheet was 10 mm/sec.

EXAMPLE 1

The dye of the above formula (2 g) and a butyral resin (Esleck BX-1 manufactured by Sekisui Chemical Co., Ltd.) (2 g) as a binder resin were dissolved in a mixed solvent of toluene (21 g) and methyl ethyl ketone (9 g) to prepare an ink. Then, the ink was coated on the base sheet with a wire bar at a coated amount after drying of 3 g/m$^2$ and dried to form a dye-containing layer.

In a separate step, to a four-necked flask equipped with a thermometer, a reflux condenser, a dropping funnel, a nitrogen-inlet tube and a stirrer, a 30 wt. % solution of a linear dihydroxydimethylpolysiloxane having an average molecular weight of 120,000 as a polysiloxane having the terminal hydroxyl groups in toluene (30 parts) and toluene (100 parts) were charged and heated to 80° C. in a nitrogen atmosphere. To the content, 20% by weight of a homogeneous monomer mixture consisting of methyl methacrylate (70 parts), butyl acrylate (20 parts), acrylic acid (5 parts), γ-methacryloxypropyltrimethoxysilane (5 parts) and azobisisobutyronitrile (2 parts) was added and polymerized at 80° C. for 30 minutes. Then, at the same temperature, the rest of the monomer mixture was dropwise added over 2 hours followed by stirring for 2.5 hours followed by dilution with isopropanol (10 parts) Thereafter, the reaction mixture was post-polymerized at 80° C. for 1 hour and half followed by cooling to obtain a solution of a polysiloxane graft polymer (hereinafter referred to as "polymer solution (1)"). To the obtained polymer solution (1) (40 parts) diluted with isopropanol (60parts), a 28% aqueous ammonia (3 parts) was added while stirring followed by stirring for 10 minutes.

Then, to the mixture, water (237 parts) was added to form an aqueous dispersion. After raising the internal temperature to 60° C., the liquid components (250 parts) were distilled off under reduced pressure to remove the solvents. Thereafter, the aqueous ammonia and water were added to adjust pH to 9.0 and the concentration to 30% to obtain an aqueous dispersion of polysiloxane graft polymer (hereinafter referred to as "aqueous dispersion (1)"). To the aqueous dispersion (1) (10 g), a 10 wt. % aqueous solution of polyvinyl alcohol (Poval 420 manufactured by Kuraray) (0.3 g) and water (20 g) were added to dilute the dispersion. The diluted dispersion was coated on the already formed dye-containing layer with a wire bar at a coated amount after drying of about 0.3 g/m$^2$ and dried at 100° C. for 2 minutes dye-permeable layer to obtain a dye transfer type thermal

EXAMPLE 2

In the same manner as in Example 1, the dye-containing layer was formed on the base sheet.

In a separate step, to the same four-necked flask as used in Example 1, a 30 wt. % solution of the same dihydroxydimethylpolysiloxane as used in Example 1 (33.3 parts) and toluene (100 parts) were charged and heated to 80° C. in a nitrogen atmosphere. Then, a homogeneous monomer mixture consisting of methyl methacrylate (50 parts), butyl acrylate (20 parts), acrylonitrile (20 parts), acrylic acid (5 parts, γ-methacryloxypropyltrimethoxysilzne (5 parts) and azobisisobutyronitrile (2 parts) was prepolymerized and polymerized with dropwise addition of the homogeneous monomer mixture in the same manners as in Example 1. After the addition of the monomer mixture, the reaction mixture was further polymerized for 3 hours and 30 minutes and diluted with ethanol (100 parts). Further, the mixture was postpolymerized at 80° C. for 30 minutes and cooled to obtain a solution of polysiloxane graft polymer (hereinafter referred to as "polymer solution (2)"). In the same manners as in Example 1 but adding 2.5 parts of the 28% aqueous ammonia to 200 parts of the obtained polymer solution (2), an aqueous dispersion of the polysiloxane graft polymer (hereinafter referred to as "aqueous dispersion (2)") was prepared.

The aqueous dispersion (2) was coated on the already formed dye-containing layer with a wire bar at a coated amount after drying of about 0.5 g/m$^2$ and dried at 80° C. for 2 minutes to form a dye-permeable layer to obtain a dye transfer type thermal printing sheet.

EXAMPLE 3

In the same manner as in Example 1, the dye-containing layer was formed.

To the aqueous dispersion (2) prepared in Example 2, a dispersion of polytetrafluoroethylene fine powder (TF 5032 supplied by Hoechst Japan, particle size of 0.1 to 0.5 μm) was added in such amount that the 30% of the solid content consisted of the polytetrafluoroethylene fine powder. Then, the mixture was coated on the dye-containing layer in the same manner as in Example 1 to form a dye-permeable layer to obtain a dye transfer type printing sheet.

EXAMPLE 4

In the same manner as in Example 1, the dye-containing layer was formed.

Then, a paint composition consisting of a solution of water-dispersible urethane ionomer resin (Hydran AP 40 manufactured by Dainippon Ink, solid content: 22% by weight) (5 g) and polyvinyl alcohol (Gosenol KH-17 manufactured by Nippon Gosei Kagaku Co., Ltd.) (0.02 g) in water (12.5 g) was coated on the dye-containing layer at a coated amount after drying of about 0.2 g/m$^2$ and dried to form a first dye-permeable layer.

In a separate step, to the same four-necked flask as used in Example 1, a linear dihydroxydimethylpolysiloxane having an average molecular weight of 48,000 (3 parts) and toluene (100 parts) were charged and heated to 80° C. in a nitrogen atmosphere. Then, a homogeneous monomer mixture consisting of methyl methacrylate (50 parts), styrene (30 parts), vinyl acetate (25 parts), acrylic acid (10 parts), 2-styrylethyltrimethoxysilane (5 parts) and azobisisobutyronitrile (2 parts) was prepolymerized and polymerized with dropwise addition of the homogeneous monomer mixture in the same manners as in Example 1. After the addition of the monomer mixture, the reaction mixture was further polymerized for 15 minutes and diluted with isopropanol (100 parts). Further, the mixture was post-polymerized at 80° C. for 3 hours and 45 minutes and cooled to obtain a solution of polysiloxane graft polymer (hereinafter referred to as "polymer solution (3)"). To 200 parts of the obtained polymer solution (3), 2 parts of the 28% aqueous ammonia was added and stirred for 10 minutes followed by addition of water (238 parts) to obtain an aqueous dispersion of the polysiloxane graft polymer (hereinafter referred to as "aqueous dispersion (3)"). In the same manner as in Example 2, the aqueous dispersion (3) was coated on the already formed first dye-permeable layer at a coated amount after drying of about 0.2 g/m$^2$ to form a second dye-permeable layer to obtain a dye transfer type thermal printing sheet.

EXAMPLE 5

In the same manner as in Example 1, the dye-containing layer was formed.

In the same manner as in Example 1 but using, as the polysiloxane having the terminal hydroxyl groups, a linear dihydroxydimethylpolysiloxane having an average molecular weight of 560, an aqueous dispersion of the polysiloxane graft polymer (hereinafter referred to as "aqueous dispersion (4)") was prepared.

The aqueous dispersion (4) was coated on the already formed dye-containing layer with a wire bar at a coated amount after drying of about 0.5 g/m$^2$ and dried at 80° C. for 2 minutes to form a dye-permeable layer to obtain a dye transfer type thermal printing sheet.

EXAMPLE 6

In the same manner as in Example 1 but using, as he polysiloxane having the terminal hydroxyl groups, a 30 wt. % solution of a partially branched dimethylpolysiloxane having an average molecular weight of 260,000 in toluene, an aqueous dispersion of the polysiloxane graft polymer (hereinafter referred to as "aqueous dispersion (5)") was prepared.

On the dye-containing layer which had been formed in the same manner as in Example 1, the aqueous dispersion (5) was coated with a wire bar at a coated amount after drying of about 0.3 g/m$^2$ and dried at 80° C. for 2 minutes to form a dye-permeable layer to obtain a dye transfer type

EXAMPLE 7

In the same manner as in Example 1, the dye-containing layer was formed.

To the aqueous dispersion (2) prepared in Example 2 (3.3 g), a 40% aqueous solution of glyoxal (0.5 g) was added to form a paint. Then, the paint was coated on the already formed dye-containing layer and dried in the same manner as in Example 2 to form a dye-permeable layer to obtain a dye transfer type thermal printing sheet.

EXAMPLE 8

In the same manner as in Example 1, the dye-containing layer was formed.

In the aqueous dispersion (3) prepared in Example 4, the same dye (0.01 g) was dissolved. Then, the dispersion was diluted with water (27parts) and isopropanol (3 part) to prepare a paint for the dye-permeable layer. The, this paint was coated on the dye-containing layer to a coated amount after drying of 0.4 g/m$^2$ and dried at 90° C. for 1.5 minutes to form a dye-permeable layer to obtain a dye transfer type thermal printing sheet.

COMPARATIVE EXAMPLE 1

In the same manner as in Example 1 but forming no dye-permeable layer, a dye transfer type thermal printing sheet was produced.

COMPARATIVE EXAMPLE 2

On the dye-containing layer which had been formed on the base sheet in the same manner as in Example 1, a solution of a butyral resin (BX-1) (1 g), paraffin wax having a melting pint of 69° C. (0.05 g) and oleic amide (0.05 ketone (9 g) was coated with a wire bar at a coated amount after drying of about 0.8 g/m$^2$ and dried to form a dye-permeable layer to obtain a dye transfer type thermal printing sheet. After coating of the solution, the paint containing a considerable amount of the dissolved dye adhered to the wire bar.

COMPARATIVE EXAMPLE 3

On the dye-containing layer which had been formed on the base sheet in the same manner as in Example 1, a solution of a polyvinyl alcohol having the saponification value of 50% (1 g) in a mixed solvent of water (15 g) and ethanol (15 g) was coated with a wire bar at a coated amount after drying of about 0.2 g/m$^2$ and dried to form a dye-permeable layer to obtain a dye transfer type thermal printing sheet.

COMPARATIVE EXAMPLE 4

On the dye-containing layer which had been formed on the base sheet in the same manner as in Example 1, a solution of a paint consisting of an emulsion of silicone oil (unvolatile components, 30%) (1 g) and a 6% aqueous solution of a water-soluble polyester (Polyestar WR 901 manufactured by Nippon Gosei Kagaku Co., Ltd.) (30 g) was coated with a wire bar at a coated amount after drying of about 0.2 g/m$^2$ and dried to form a dye-permeable layer to obtain a dye transfer type thermal printing sheet. After about 30 minutes from the production, recrystallization started on the dye layer. Therefore, the same printing sheet was reproduced and immediately subjected to the printing.

COMPARATIVE EXAMPLE 5

In the same four-necked flask as used in Example 1, toluene (100 parts) was charged and heated to 80° C. under a nitrogen atmosphere. To toluene, a homogeneous monomer mixture which consisted of a polysiloxane macromer consisting of a polydimethylsiloxane part having a molecular weight of 10,000 and, at chain ends, a methacryloxypropyl group and a methyl group (3 parts), methyl methacrylate (70 parts), butyl acrylate (20 parts), acrylic acid (5 parts), γ-methacryloxypropyltrimethoxysilane (5 parts) and azobisisobutyronitrile (2 parts) was added and polymerized in the same manner as in Example 1 to obtain a polymer solution (hereinafter referred to as "polymer solution (4)"). When the polymer solution (4) was kept standing, the polysiloxane was separated in the upper layer. This means that substantially no polysiloxane macromer was reacted.

COMPARATIVE EXAMPLE 6

In the same manner as in Comparative Example 5 but using the polysiloxane macromer consisting of a polydimethylsiloxane part having a molecular weight of 500, a solution of the polysiloxane graft polymer was prepared (hereinafter referred to as "polymer solution (5)").

In the same manner as in Example 1 but using the polymer solution (5), an aqueous dispersion of the polysiloxane graft polymer was prepared (hereinafter referred to as "aqueous dispersion (5)").

On the dye-containing layer which had been formed on the base sheet in the same manner as in Example 1, the aqueous dispersion (5) was coated with a wire bar at a 80° C. for 2 minutes to form a dye-permeable layer to obtain a dye transfer type thermal printing sheet.

COMPARATIVE EXAMPLE 7

In the same four-necked flask as used in Example 1, deionized water (220 parts) and an anionic type emulsifier (1 part) were charged and heated to 80° C. in an nitrogen atmosphere.

Separately, a monomer mixture consisting of a polysiloxane macromer consisting of a polydimethylsiloxane part having a molecular weight of 10,000 and, at chain ends, a methacryloxypropyl group and a methyl group (3 parts), methyl methacrylate (70 parts), butyl acrylate (20 parts), acrylic acid (5 parts), γ-methacryloxypropyltrimethoxysilane (5 parts) was prepared. The monomer mixture in an amount corresponding to 10% by weight of the whole monomer mixture and a 10% aqueous solution of ammonium persulfate (10 parts) were added to the mixture in the flask and emulsion polymerized at 80° C. for 10 minutes. Thereafter, the rest of the monomer mixture was dropwise added over 2 hours followed by stirring at at 80° C. for 2 hours to complete the emulsion polymerization. When the prepared aqueous dispersion of the polysiloxane graft polymer (hereinafter referred to as "aqueous dispersion (6)") was kept standing, the polysiloxane was separated in the upper layer, and no homogeneous aqueous dispersion was obtained.

COMPARATIVE EXAMPLE 8

In the same manner as in Example 1, the dye-containing layer was formed.

In a separate step, to the same four-necked flask as used in Example 1, a 30 wt. % solution of the same dihydroxydimethylpolysiloxane as used in Example 1 (1 part) and toluene (100 parts) were charged and heated to 80° C. in a nitrogen atmosphere. Then, a homogeneous monomer mixture consisting of methyl methacrylate (50 parts), butyl acrylate (20 parts), acrylonitrile (20 parts), acrylic acid (5 parts), γ-methacryloxypropyltrimethoxysilane (5 parts) and azobisisobutryronitrile (2 parts) was prepolymerized and polymerized with dropwise addition of the homogeneous monomer mixture in the same manner as in Example 1. After the addition of the monomer mixture, the reaction mixture was further polymerized for 30 minutes and diluted with ethanol (100 parts). Further, the mixture was post-polymerized at 80° C. for 3 hours and 30 minutes and cooled to obtain a solution of polysiloxane graft polymer (hereinafter referred to as "polymer solution (6)"). In the same manners as in Example 1 but adding 2.5 parts of the 28% aqueous ammonia to 200 parts of the obtained polymer solution (6), an aqueous dispersion of the polysiloxane graft polymer (hereinafter referred to as "aqueous dispersion (7)") was prepared.

The aqueous dispersion (7) was coated on the already formed dye-containing layer with a wire bar at a coated amount after drying of about 0.5 g/m$^2$ and dried at 80° C. for 2 minutes to form a dye-permeable layer to obtain a dye transfer type thermal printing sheet.

COMPARATIVE EXAMPLE 9

To the same four-necked flask as used in Example 1, a 30 wt.% solution of the same dihydroxydimethylpolysiloxane as used in Example 1 (100 parts) and toluene (50 parts) were charged and heated to 80° C. in a nitrogen atmosphere. Then, a homogeneous monomer mixture consisting of methyl methacrylate (50 parts), butyl acrylate (23 parts), acrylonitrile (15 parts), acrylic acid (5 parts), γ-methacryloxypropyltrimethoxysilane (7 parts) and azobisisobutyronitrile (2 parts) was prepolymerized and polymerized with dropwise addition of the homogeneous monomer mixture in the same manners as in Example 1. After the addition of the monomer mixture, the reaction mixture was further polymerized for 30 minutes and diluted with ethanol (100 parts). Further, the mixture was post-polymerized at 80° C. for 3 hours and 30 minutes and cooled to obtain a solution of polysiloxane graft polymer (hereinafter referred to as "polymer solution (7)"). When the polymer solution (7) was kept standing, the polysiloxane was separated in the upper layer. This means that the polysiloxane was not sufficiently introduced in the prepared graft polymer.

COMPARATIVE EXAMPLE 10

To the same four-necked flask as used in Example 1, a 30 wt. % solution of the same dihydroxydimethylpolysiloxane as used in Example 1 (10 parts) and toluene (100 parts) were charged and heated to 80° C. in a nitrogen atmosphere. Then, a homogeneous monomer mixture consisting of methyl methacrylate (70 parts), butyl acrylate (5 parts), acrylic acid (5 parts), γ-methacryloxypropyltrimethoxysilane (20 parts) and azobisisobutyronitrile (2 parts) was prepolymerized and polymerized with dropwise addition of the homogeneous monomer mixture in the same manners as in Example 1. During the dropwise addition of the monomer mixture, the reaction mixture was gelled. Immediately, ethanol (100 parts) and toluene (100 parts) were added to dilute the mixture. However, the gellation could not be prevented, and the polymerization reaction was terminated.

COMPARATIVE EXAMPLE 11

To the same four-necked flask as used in Example 1, a 30 wt. % solution of the same dihydroxydimethylpolysiloxane as used in Example 1 (10 parts) and toluene (100 parts) were charged and heated to 80° C. in a nitrogen atmosphere. Then, a homogeneous monomer mixture consisting of methyl methacrylate (70 parts), butyl acrylate (25 parts), acrylic acid (5 parts), γ-methacryloxypropyltrimethoxysilane (0.02 part) and azobisisobutyrOnitrile (2 parts) was prepolymerized and polymerized with dropwise addition of the homogeneous monomer mixture in the same manners as in Example 1. After the addition of the monomer mixture, the reaction mixture was further polymerized for 30 minutes and diluted with ethanol (100 parts). Further, the post-polymerized at 80° C. for 3 hours and 30 minutes and cooled to obtain a solution of polysiloxane graft polymer (hereinafter referred to as "polymer solution (8)"). When the polymer solution (7) was kept standing, the polysiloxane was separated in the upper layer. This means that the polysiloxane was not sufficiently introduced in the prepared graft polymer.

COMPARATIVE EXAMPLE 12

In the same manner as in Example 1, the dye-containing layer was formed.

In a separate step, to the same four-necked flask as used in Example 1, a 30 wt. % solution of the same dihydroxydimethylpolysiloxane as used in Example 1 (10 parts) and toluene (100 parts) were charged and heated to mixture consisting of methyl methacrylate (55 parts), acrylic acid (40 parts), γ-methacryloxypropyltrimethoxysilane (5 parts) and azobisisobutyronitrile (2 parts) was prepolymerized and polymerized with dropwise addition of the homogeneous monomer mixture in the same manners as in Example 1. After the addition of the monomer mixture, the reaction mixture was further polymerized for 30 minutes and diluted with ethanol (100 parts). Further, the mixture was postpolymerized at 80° C. for 3 hours and 30 minutes and cooled to obtain a solution of polysiloxane graft polymer (hereinafter referred to as "polymer solution (9)"). In the same manners as in Example 1, 2.5 parts of the 28% aqueous ammonia was added to 200 parts of the obtained polymer solution (9). But the mixture was gelled and no aqueous dispersion of the polysiloxane graft polymer which could be used as a paint was obtained.

Figure 4:
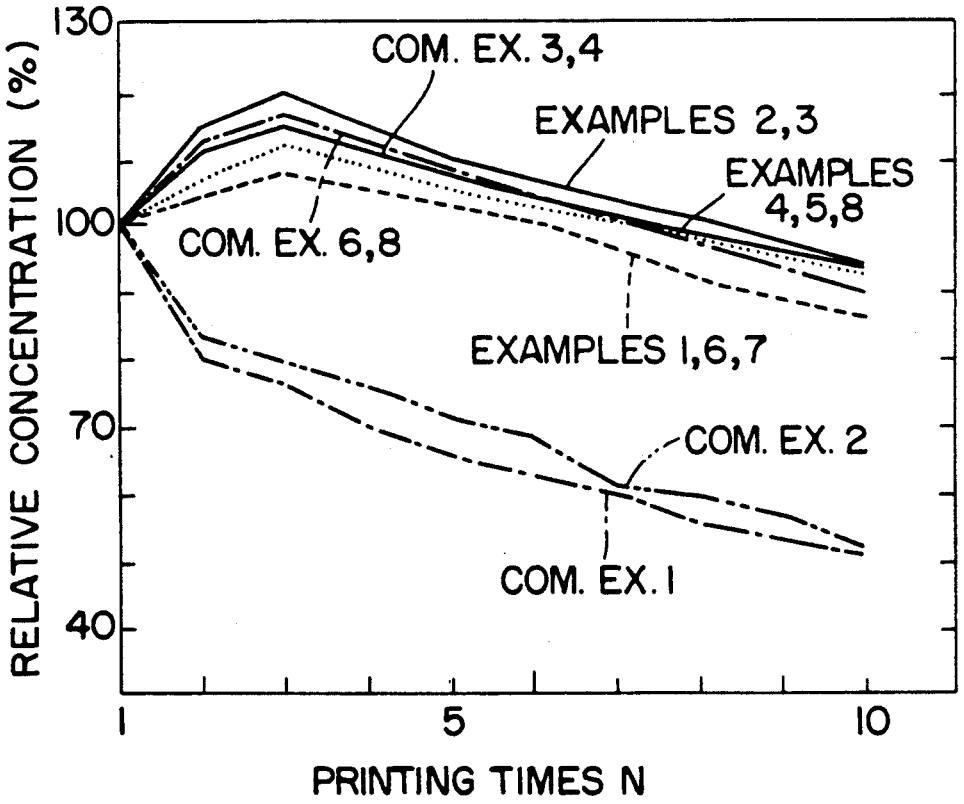
FIG. 4 is a graph showing relative ratios of transferred dye amounts against the number of prints (N) in the multiple printing in Examples and Comparative Examples.

Each of the dye transfer type thermal printing sheets prepared in Examples and Comparative Examples was used in printing. In Table the recording energy which represents the recording sensitivity and was required at a print density of 1.8 when the image was printed on an image-print receiving sheet and a maximum recording energy at which the relative speed printing was possible are summarized. In FIG. 4, the multiple printing characteristics (a relative recording concentration at n-times printing) are shown.

In Table, the maximum recording energies 1 and 2 are maximum recording energies when a moving speed of the printing sheet is 1.0 mm/sec. and 2.0 mm/sec., respectively. At the moving speed of 2.0 mm/sec., since the speed difference between the printing sheet and the image-receiving sheet is smaller than at the moving speed of 1.0 mm/sec., the relative speed printing is more difficult.

In FIG. 4, the relative ratio of transferred dye amount (transferred dye amount at n-th time/transferred dye amount at first time, %) at the same recording energy in the simple repeating method is shown.

TABLE

| Example No. | Recording energy ($J/cm^2$) | Maximum recording energy 1 ($J/cm^2$) | Maximum recording energy 2 ($J/cm^2$) |
|---|---|---|---|
| 1 | 6.0 | ≧8 | ≧8 |
| 2 | ↑ | ↑ | ↑ |
| 3 | 6.5 | ↑ | ↑ |
| 4 | 6.0 | ↑ | ↑ |
| 5 | ↑ | 7.0 | 6.5 |
| 6 | ↑ | ≧8 | ≧8 |
| 7 | ↑ | ↑ | ↑ |
| 8 | ↑ | ↑ | ↑ |
| Comp. 1 | 4.5 | 3.0 | Impossible |
| Comp. 2 | 5.0 | ≧8 | ≧8 |
| Comp. 3 | 6.0 | 3.5 | 3.0 |
| Comp. 4 | ↑ | ≧8 | ≧8 |
| Comp. 6 | ↑ | 6.5 | 5.0 |

TABLE -continued

| Example No. | Recording energy ($J/cm^2$) | Maximum recording energy 1 ($J/cm^2$) | Maximum recording energy 2 ($J/cm^2$) |
|---|---|---|---|
| Comp. 8 | ↑ | 4.5 | 3.5 |

What is claimed is:

1. A dye transfer type thermal printing sheet comprising a base sheet, a dye-containing layer formed on the base sheet and a dye-permeable layer which is formed on the dye-containing layer and comprises at least one water dispersible polysiloxane graft polymer which is obtainable by polymerizing (B) 0.05 to 10% by weight of a polymerizable silane compound, (C) 1 to 30% by weight of an unsaturated organic acid and (D) 40 to 97.95% by weight of a monomer which is copolymerizable with the silane compound (B) and the unsaturated organic acid (C) in the presence of (A) 1 to 20% by weight of a polysiloxane having terminal hydroxyl groups (provided that the total of the components (A), (B), (C) and (D) is 100% by weight) in an organic solvent except an alcohol or at least one salt of said graft polymer with a base.

2. The dye transfer type thermal printing sheet according to claim 1, wherein said salt is obtainable by reacting the polysiloxane graft polymer with a base in an amount of 20 to 200% by mole based on acidic groups contained in the polysiloxane graft polymer.

3. The dye transfer type thermal printing sheet according to claim 1, wherein said polysiloxane (A) having the terminal hydroxyl groups has an average molecular weight of 5000 to 1,500,000.

4. A method for producing a dye transfer type thermal printing sheet comprising steps of applying a paint for forming a dye-containing layer on a base sheet and applying an aqueous dispersion for a dye-permeable layer which comprises at least one water dispersible polysiloxane graft polymer which is obtainable by polymerizing (B) 0.05 to 10% by weight of a polymerizable silane compound, (C) 1 to 30% by weight of an unsaturated organic acid and (D) 40 to 97.95 by weight of a monomer which is copolymerizable with the silane compound (B) and the unsaturated organic acid (C) in the presence of (A) 1 to 20% by weight of a polysiloxane having terminal hydroxyl groups (provided that the total of the components (A), (B), (C) and (D) is 100% by we an organic solvent except an alcohol or at least one salt of said graft polymer with a base.

5. The method according to claim 4, wherein said salt is obtainable by reacting the polysiloxane graft polymer with a base of 20 to 200% by mole based on acidic groups contained in the polysiloxane graft polymer.

6. The method according to claim 4, wherein said aqueous dispersion for the dye-permeable layer further comprises a cross linking agent.

* * * * *